US007942413B2

(12) United States Patent
Eguchi

(10) Patent No.: US 7,942,413 B2
(45) Date of Patent: May 17, 2011

(54) IMAGE FORMING APPARATUS PROVIDED WITH OUTPUT TRAY AND CONTROL METHOD THEREOF

(75) Inventor: Tatsuya Eguchi, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 247 days.

(21) Appl. No.: 12/248,751

(22) Filed: Oct. 9, 2008

(65) Prior Publication Data

US 2009/0121424 A1 May 14, 2009

(30) Foreign Application Priority Data

Nov. 14, 2007 (JP) ..... 2007-295830

(51) Int. Cl.
*B65H 29/00* (2006.01)

(52) U.S. Cl. ..... 271/279; 271/278

(58) Field of Classification Search ..... 271/215, 271/289, 290, 278, 279
See application file for complete search history.

(56) References Cited

U.S. PATENT DOCUMENTS

2006/0261543 A1 11/2006 Miyake et al.

FOREIGN PATENT DOCUMENTS

| | | |
|---|---|---|
| JP | 64-3747 | 1/1989 |
| JP | 10-203724 | 8/1998 |
| JP | 2002-12365 | 1/2002 |
| JP | 2003-26370 | 1/2003 |
| JP | 2004-115236 | 4/2004 |
| JP | 2006-315812 | 11/2006 |

OTHER PUBLICATIONS

Japanese Notice of Grounds of Rejection mailed Oct. 6, 2009, directed to Japanese Patent Application No. 2007-295830; 4 pages.

*Primary Examiner* — Stefanos Karmis
*Assistant Examiner* — Howard Sanders
(74) *Attorney, Agent, or Firm* — Morrison & Foerster LLP

(57) ABSTRACT

In an image forming apparatus, a sheet is discharged onto an output tray. The image forming apparatus includes a ranging sensor which measures a distance to an object from a position located away by a predetermined distance from a bottom surface of the output tray in a sheet loading direction on a line in parallel with the bottom surface of the output tray and orthogonal to a direction in which the sheet is discharged. In the image forming apparatus, discharge of the sheet onto the output tray is stopped when the distance to the object measured by the ranging sensor is lower than a specific distance.

8 Claims, 10 Drawing Sheets

IMAGE FORMING APPARATUS PROVIDED WITH OUTPUT TRAY AND CONTROL METHOD THEREOF

This application is based on Japanese Patent Application No. 2007-295830 filed with the Japan Patent Office on Nov. 14, 2007, the entire content of which is hereby incorporated by reference.

BACKGROUND OF THE INVENTION

1. Field of the Invention

The present invention relates to an image forming apparatus, particularly to an image forming apparatus being able to properly detect a loading state of sheets in an output tray to which a sheet on which an image is formed is discharged, and a method of controlling the image forming apparatus.

2. Description of the Related Art

Conventionally, in the image forming apparatus, sometimes the sheet discharged on the output tray is misaligned by the newly-discharged sheet or pushed out from the output tray. In order to avoid such situations, a technique of detecting the loading state of the sheet on the output tray is used to stop the discharge of the sheet onto the output tray when the tray is judged to be fully loaded.

There have been disclosed various techniques concerning the technique of detecting the loading state of the sheet on the output tray to avoid the newly-discharged sheet from pushing out the already stacked sheet.

For example, Japanese Laid-Open Patent Publication No. 10-203724 and No. 2002-012365 disclose a technique of determining how many sheets are stacked on the output tray based on a distance between a ranging sensor fixed to a neighborhood of a discharge port and a point on the sheet located at a top-most position of the output tray.

Japanese Laid-Open Patent Publication No. 2004-115236 discloses a technique of providing a lever abutting on the sheet stacked on the output tray, a light shielding member rotated in conjunction with operation of the lever, and a photosensor. In the technique, the lever and the light shielding member are configured such that rotation angles of the lever and light shielding member are changed according to the number of sheets stacked on the output tray, and a degree of light shielding to the photosensor is changed by the change in rotation angle of the light shielding member. According to the technique, the sheets are stacked such that the light shielding member is rotated to a position where light incident to the photosensor is shielded at least a predetermined degree, which determines that the output tray is fully loaded with the sheets.

However, in the techniques described above, the detection of the number of sheets discharged on the output tray is performed only by detecting the distance between a point on a principal plane (surface in which an image is formed or backside thereof) of the sheet and a specific position (for example, the ranging sensor) in a direction of the principal plane.

Specifically, the number of sheets is detected only at a point X with respect to an output tray 990 as shown in FIG. 14 or at a point Y with respect to the output tray 990 as shown in FIG. 15.

FIGS. 14 and 15 schematically show a neighborhood of the output tray 990 when viewed from a side face. In FIGS. 14 and 15, a sheet P is discharged onto the output tray 990 through a roller 991, and the existence of sheet P is detected at point X or Y located at a level of a distance HA from the output tray 990.

FIG. 14 shows the state sheet P on the output tray 990 is curled such that a central portion of sheet P swells when sheet P is viewed along a discharge direction RP of sheet P. FIG. 15 shows the state sheet P on the output tray 990 is curled such that front-end and rear-end portions of sheet P swell (the central portion is bowed inward) when sheet P is viewed along the discharge direction RP.

In the conventional sheet detection technique, as shown in FIGS. 14 and 15, in the case where a part (the central portion of sheet P in FIG. 14 or the front-end and rear-end portions of sheet P in FIG. 15) of sheet P stacked on the output tray 990 is higher than other portions, when the number of sheets is detected based on the point (point X in FIG. 14 or point Y in FIG. 15) in the portion except for the swell portion, the newly-discharged sheet abuts on the "swell portion" in sheet P already stacked on the output tray 990, which permits sheet P to be pushed out. This is because the newly-discharged sheet collides with the portion located higher than the point (point X or point Y) used to detect sheet P on the output tray 990. That is, an arrow indicating the discharge direction RP intersects a line indicating sheet P on the output tray 990 in FIGS. 14 and 15.

SUMMARY OF THE INVENTION

In view of the foregoing, an object of the present invention is to provide an image forming apparatus which can surely prevent a sheet already stacked on an output tray from colliding with a sheet newly discharged onto the output tray, and a control method thereof.

An image forming apparatus according to the present invention includes: an output tray on which a sheet is placed; a discharge unit which discharges the sheet onto the output tray; a ranging unit which measures a distance to an object from a position located away by a predetermined distance from a bottom surface of the output tray in a sheet loading direction on a line being located in parallel with the bottom surface of the output tray and orthogonal to a direction in which the discharge unit discharges the sheet; and a control unit which stops sheet discharge performed by the discharge unit when the distance measured by the ranging unit is lower than a specific distance.

A method of controlling an image forming apparatus according to the present invention includes a discharge unit which discharges a sheet onto an output tray, the method including the steps of measuring a distance to an object from a position located away by a predetermined distance from a bottom surface of the output tray in a sheet loading direction on a line being located in parallel with the bottom surface of the output tray and orthogonal to a direction in which the discharge unit discharges the sheet; determining whether or not the distance measured in the distance measuring step is lower than a specific distance; and stopping discharge of the sheet to the output tray performed by the discharge unit when the distance measured in the distance measuring step is lower than the specific distance.

According to the present invention, in the image forming apparatus, the distance to the object is measured from the position located away by the predetermined distance (height) from the bottom surface of the output tray on the line in parallel with the bottom surface of the output tray and orthogonal to the sheet discharge direction.

In the present invention, the distance measured by the ranging unit is not lower than the specific distance when the sheets are not fully loaded on the output tray, and the distance measured by the ranging unit is lower than the specific distance when at least a part of the sheet is fully loaded on the output tray. The discharge of the sheet to the output tray by the discharge unit is stopped when the distance measured by the ranging unit is lower than the specific distance.

That is, in the image forming apparatus, the existence of the sheet is detected in parallel with the bottom surface of the output tray and in the direction orthogonal to the direction in which the discharge unit discharges the sheet, so that the existence of the sheet on the output tray can be detected not at the point but on the line at a predetermined level from the bottom surface of the output tray.

Therefore, the image forming apparatus can detect the state of the sheet on the output tray, even if only a part of the sheet swells in the sheet discharge direction due to the curl.

Accordingly, the loading state of the sheet can correctly be detected on the output tray. Because the discharge of the sheet onto the output tray is stopped based on the detection result, the newly-discharged sheet can surely be avoided from pushing out the sheet already discharged on the output tray.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

[Overall Configuration of Image Forming Apparatus (MFP)]

Figure 1:
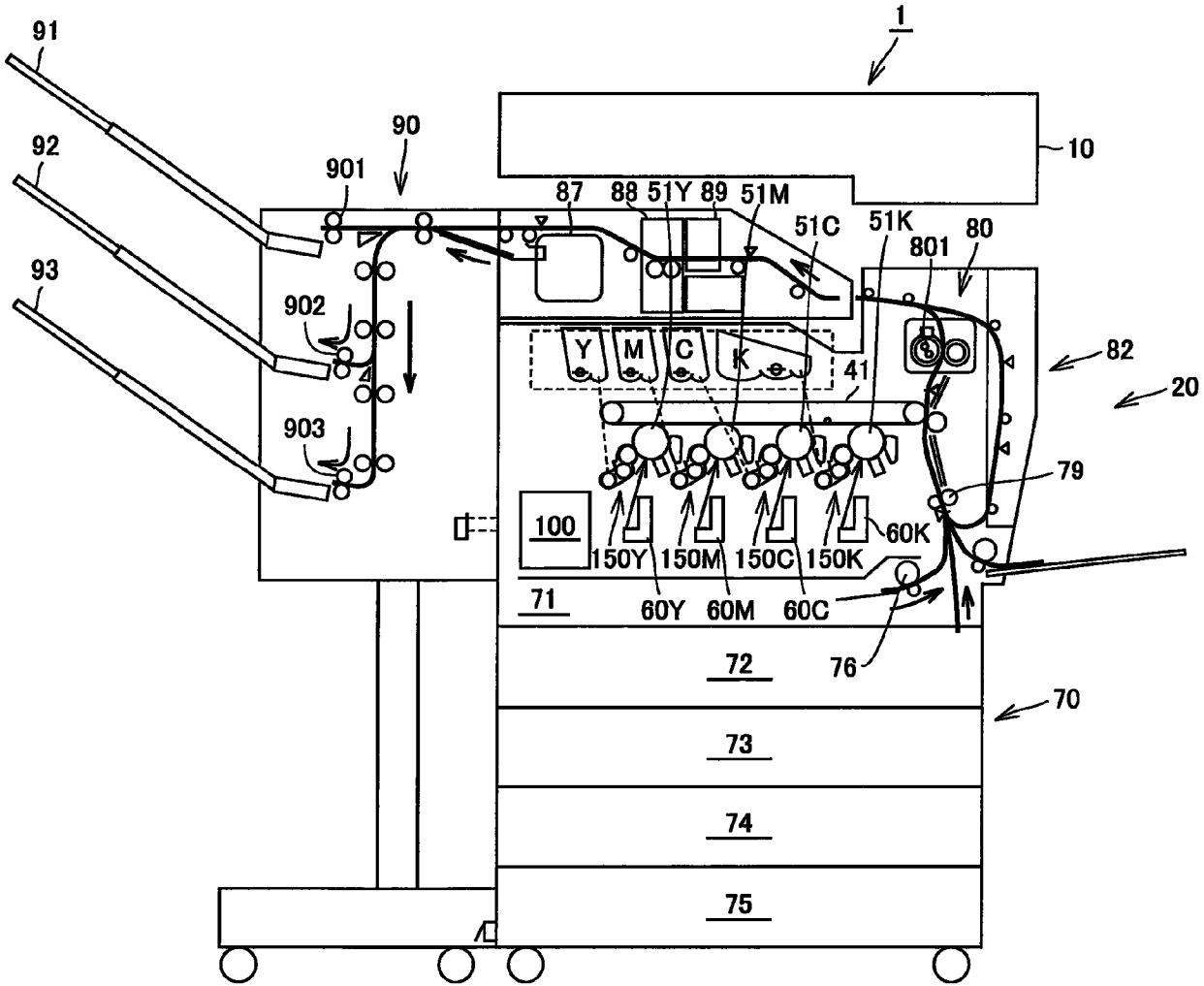
FIG. 1 schematically shows a configuration of a multi function peripheral (MFP) which is of an image forming apparatus according to an embodiment of the present invention.

FIG. 1 is a front sectional view schematically showing MFP 1 which is of an image forming apparatus according to an embodiment of the present invention. As shown in FIG. 1, MFP 1 includes an image scanning unit 10, an image forming unit 20, a discharge unit 90, and a control unit 100. Imaging units 150K, 150Y, 150M, and 150C are detachably attached to MFP 1. Imaging units 150K, 150Y, 150M, and 150C are covered with cover (front cove, not shown) and accommodated in MFP 1 when attached to MFP 1.

Image scanning unit 10 is a well-known device which includes a scanner, and image scanning unit 10 scans an image of a document on a document glass plate (not shown) by moving the scanner. In the image scanning unit 10, the document image obtained by irradiation of an exposure lamp provided in an image scanning device is imaged through a focusing lens, dispersed into three wavelengths of red (R), green (G), and blue (B) by a spectroscope, and incident to a red CCD (Charge Coupled Device) image sensor, a green CCD image sensor, and a blue CCD image sensor respectively. Control unit 100 performs AD (Analog-to-Digital) conversion of an output signal from each CCD image sensor (hereinafter simply referred to as "CCD sensor") to form image data of each of R, G, and B of the document.

Control unit 100 performs various kinds of data processing to the image data obtained in each color component, and control unit 100 converts the image data in each color component into image data of each of black (K), yellow (Y), magenta (M), and cyan (C) reproduction color (hereinafter K, Y, M, and C are added as suffix to the numeral of the component concerning the reproduction color). Each of the converted image data is stored in RAM (RAM 102) of control unit 100, and various kinds of correction processing such as registration correction are performed to the converted image data. Then, the image data is read every one scanning line in synchronization with supply of a print sheet (hereinafter simply referred to as "sheet") to form a driving signal of a laser diode with which photosensitive drums 51K, 51Y, 51M, and 51C are exposed.

Image forming unit 20 includes a transfer belt 41 which is driven while tensioned in image forming unit 20, imaging units (image forming units) 150K, 150Y, 150M, and 150C which are arranged opposite transfer belt 41 at predetermined intervals, exposure scanning units 60K to 60C which are provided in imaging units respectively, a feeding unit 70 which feeds the sheet to the transfer belt 41, a fixing unit 80 which is disposed on a downstream side of a sheet conveyance unit 40, and a both-sided unit 82.

Each of exposure scanning units 60K to 60C includes the laser diode which emits a laser beam by receiving a driving signal outputted from control unit 100 and a polygon mirror (not shown) which deflects the laser beam to scan each of photosensitive drums 51K to 51C in a main scanning direction.

Image forming unit 20 also includes a stapler 87 which staples the sheets after the image formation, a folding unit 88 which performs a folding process such as half fold, and a punch unit 89 which makes a punch hole.

Feeding unit 70 includes feeding cassettes 71 to 75 in which the sheets are accommodated, a pickup roller 76 which delivers the sheet accommodated in each feeding cassette, and a registration roller 79 which adjusts a time the delivered sheet is send to transfer belt 41. The sheets having different sizes or orientations are accommodated in feeding cassettes 71 to 75. Specifically, for example, an A5 size (laterally-fed) sheet (hereinafter, referred to as "A5 sheet") is accommodated in feeding cassette 71, an A4 size (laterally-fed) sheet (hereinafter, referred to as "A4 sheet") is accommodated in feeding cassette 72, an A4 size (longitudinally-fed) sheet (hereinafter, referred to as "A4R sheet") is accommodated in feeding cassette 73, a B4 size (laterally-fed) sheet (hereinafter, referred to as "B4 sheet") is accommodated in feeding cassette 74, and an A3 size (laterally-fed) sheet (hereinafter, referred to as "A3 sheet") is accommodated in feeding cassette 75. Although neglected in FIG. 1, the pickup rollers 76 are provided with respect to feeding cassettes 71 to 75 respectively.

The sheet onto which color toner images are multiply-transferred is conveyed to a fixing unit 80 by transfer belt 41. A fixing roller 801 of fixing unit 80 includes a heater therein, and control unit 100 controls a current passed through the heater while detecting a surface temperature of fixing roller 801 using a temperature detection sensor. Fixing roller 801 pressurizes the sheet at a high temperature to melt and fix toner particles onto the surface of the sheet, and the sheet is discharged to one of output trays 91 to 93. Exit rollers 901 to 903 corresponding to output trays 91 to 93 are provided in a discharge unit 90.

In the case where the image formation is performed to both sides of the sheet (surface and backside), in MFP 1, after the image formed in the surface of the sheet is fixed with fixing unit 80, the sheet is sent to both-sided unit 82. Then, in MFP 1, the image is formed in the backside of the sheet, and the image formed in the backside is discharged onto the output tray after fixed with fixing unit 80.

In MFP 1, a loading amount detection unit is provided in each of output trays 91 to 93. Control unit 100 detects a loading state of the sheet in each of output trays 91 to 93 using the detection amount detection unit. Control unit 100 stops the discharge of the sheet to the output tray when determining that the sheet newly discharged to the output tray pushes out the already-discharged sheet. How the discharge of the sheet is realized will be described later.

[Configuration in Neighborhood of Output Tray]

Figure 2:
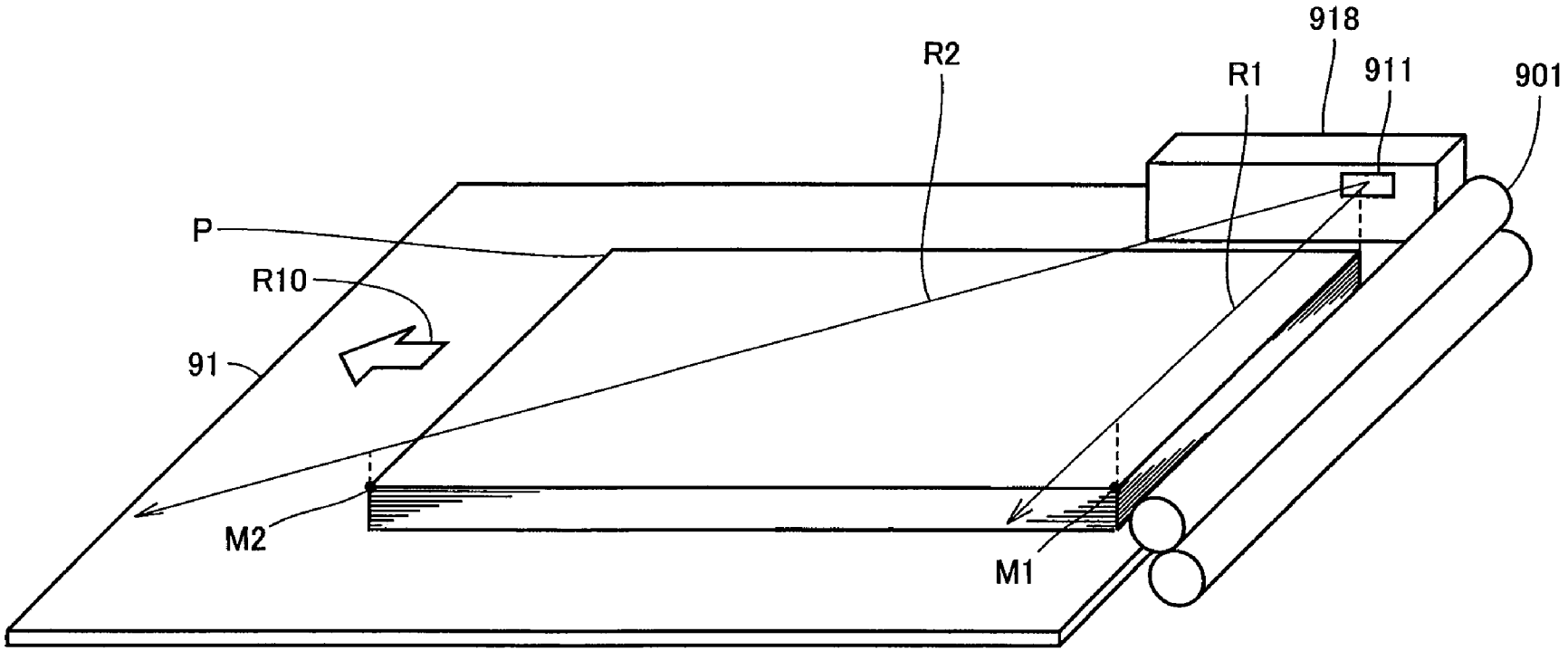
FIG. 2 schematically shows a configuration of a neighborhood of an output tray of FIG. 1.

FIG. 2 schematically shows a configuration of a neighborhood of output tray 91.

Referring to FIG. 2, a sheet P is placed on output tray 91 by delivering sheet P in a discharge direction R10 from discharge unit 90 through exit roller 901. A chassis 918 is disposed on a right side in discharge direction R10 of sheet P on output tray 91.

A ranging sensor 911 is provided in chassis 918 to measure a distance to an object existing in a direction of an arrow R1. Ranging sensor 911 is formed by a well-known sensor such as a reflection type photoelectric ranging sensor. The reflection type photoelectric ranging sensor includes a reflection type photoelectric ranging proximity switch, and the reflection type photoelectric ranging proximity switch includes a floodlighting element and a position detection element. In the case where the measurement is performed using the sensor, the distance between the sensor and the object is measured based on where a spot of the light beam emitted from the floodlighting element and reflected by the object is detected on the position detection element.

Figure 3:
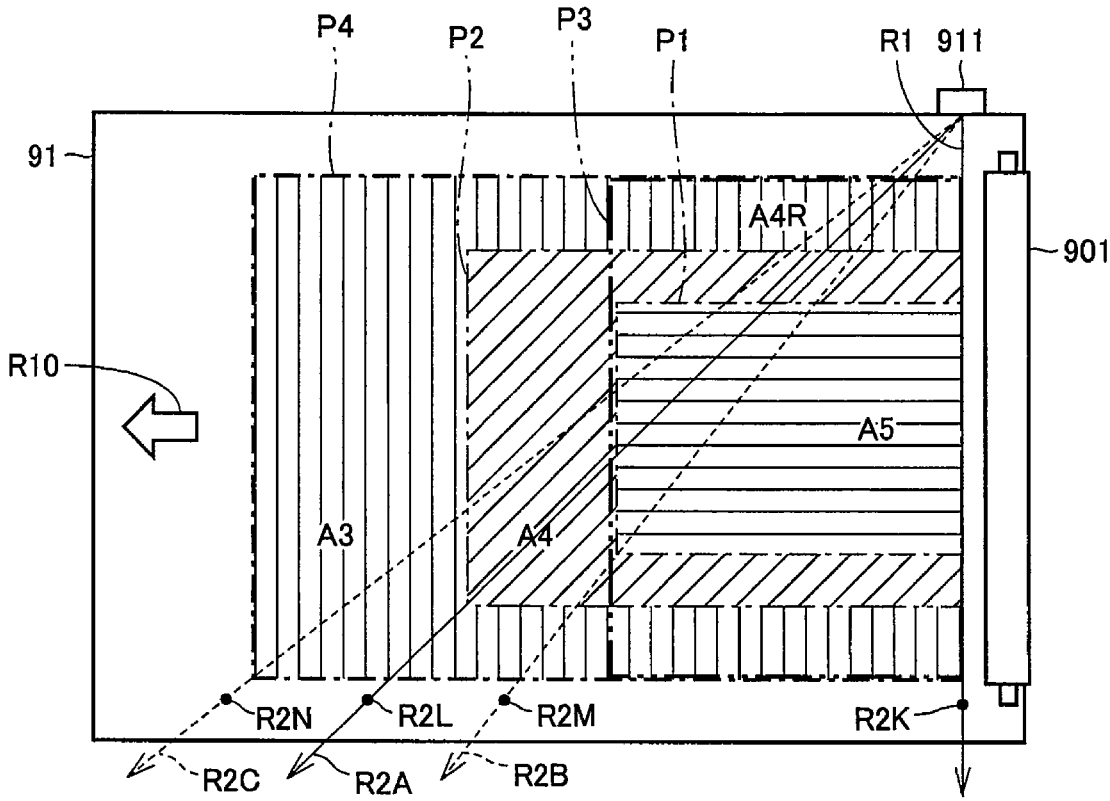
FIG. 3 schematically shows the neighborhood of the output tray of FIG. 1 when viewed from above.

FIG. 3 schematically shows output tray 91 when viewed from above.

Referring to FIG. 3, in the light beams emitted from ranging sensor 911, the light beam indicated by arrow R1 is located at a rear end of sheet P in discharge direction R10 of output tray 91. A light beam indicated by an arrow R2 in FIG. 2 is located so as to pass through a corner at a front end of sheet P in discharge direction R10 of output tray 91. The paths on which the light beams pass through arrows R1 and R2 are located on lines. The lines are located in parallel with the bottom surface of output tray 91 and by a distance HA away from the bottom surface.

Figure 4A:
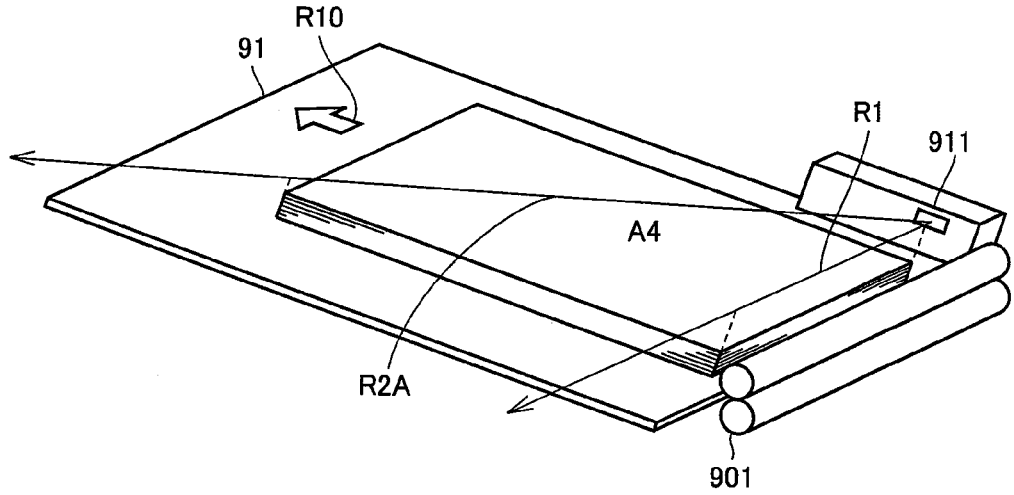
FIGS. 4A to 4C are views for explaining a state in which a path from a light emitting unit to a light receiving unit is changed according to a size and an orientation of a sheet outputted to the output tray in MFP of FIG. 1.
Figure 4B:
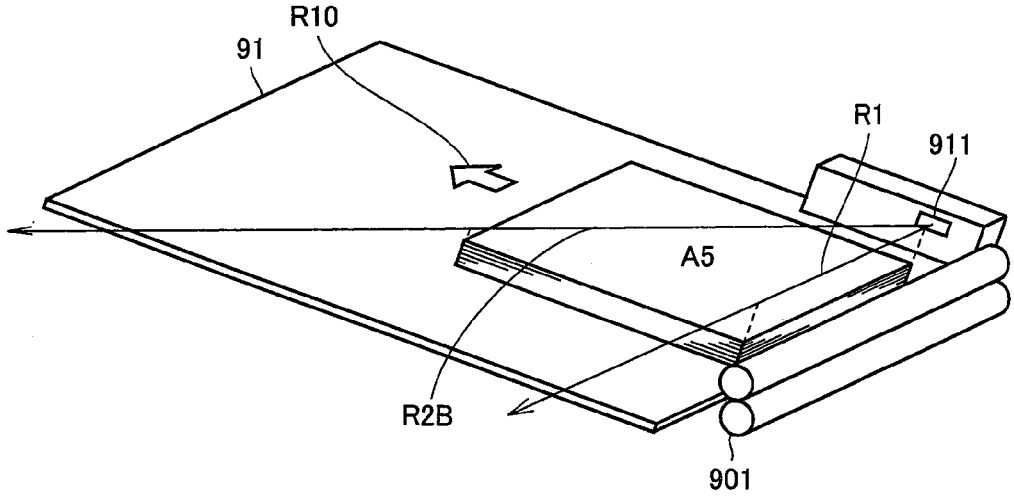
Figure 4C:
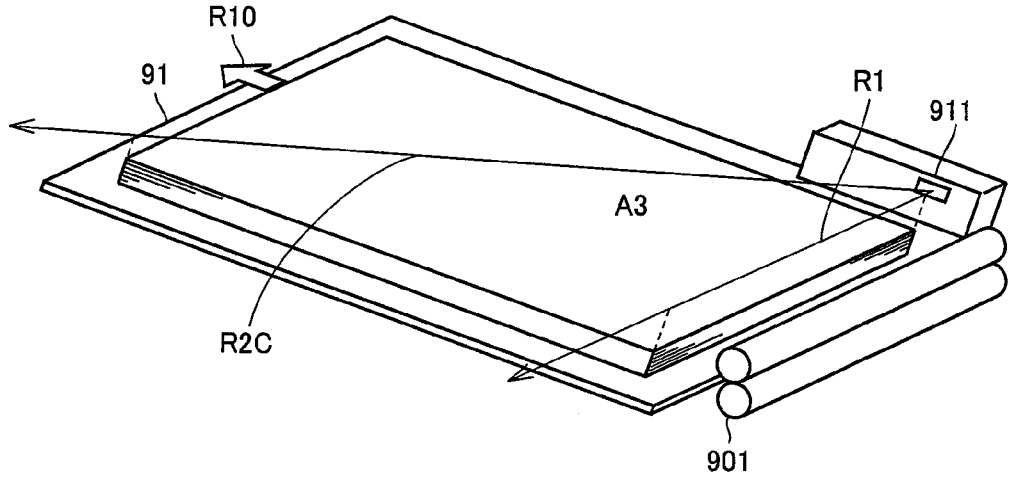

As shown in FIG. 3, in the light beams emitted from ranging sensor 911, the path indicated by arrow R2 of FIG. 2 is changed such that the light beam passes through the corner at the front end of the sheet according to the size of the sheet discharged onto output tray 91. Referring to FIGS. 4A to 4C, how the optical path is changed will be described in detail.

Referring to FIG. 4A, when the sheet discharged onto output tray 91 is the A4 sheet indicated by a frame P2 (see FIG. 3), the optical path indicated by arrow R2 of FIG. 3 is indicated by an arrow R2A.

Referring to FIG. 4B, when the sheet discharged onto output tray 91 is the A5 sheet indicated by a frame P1 (see FIG. 3), the optical path indicated by arrow R2 of FIG. 3 is indicated by an arrow R2B.

Referring to FIG. 4C, when the sheet discharged onto output tray 91 is the A3 sheet indicated by a frame P4 (see FIG. 3), the optical path indicated by arrow R2 of FIG. 3 is indicated by an arrow R2C.

Ranging sensors 911 are provided in the output tray 92 and output tray 93 so as to be operated in the same way as that of output tray 91.

Referring to FIG. 3, a frame P3 corresponds to an outer frame of the A4R sheet. Although not particularly described in the present embodiment, in MFP 1, the optical path is adjusted according to the sheet size like the descriptions of FIGS. 4A to 4C, even if the A4R sheet is selected as the size of the sheet discharged onto output trays 91 to 93. That is, one optical path (R1) of ranging sensor 911 is set on the rear end in discharge direction R10, and another optical path (R2A to R2C) of ranging sensor 911 is set so as to pass through the corner of the front end.

In the present embodiment, the existence of the sheet located at the height HA from the bottom surface of output tray 91 can be detected on the path of the light emitted from ranging sensor 911, i.e., in the continuous range in discharge direction R10. Therefore, in the present embodiment, by setting the path of ranging sensor 911 as described with reference to FIG. 2, the existence of the sheet located at the height HA from the bottom surface of output tray 91 can be detected in the substantially overall range in discharge direction R10 without providing the number of ranging sensors corresponding to plural points of the sheet on output tray 91.

In the present embodiment, the determination whether or not the output tray is in a "tray fully loaded" state is made based on whether or not the object exists in the distance shorter than the distance between the ranging sensor 911 and point R2K in the path indicated by arrow R1 and whether or not the object exists in the distance shorter than the distance between the ranging sensor 911 and point R2L, point R2M, and point R2N.

Point R2K is set to a position located from an outer edge of frame P4 by a predetermined distance (for example, several millimeters). It is assumed that a distance K is a distance between ranging sensor 911 and point R2K. Point R2L, point R2M, and point R2N are set at positions located from the outer edge of frame P4 by a predetermined distance (for example, several millimeters). It is assumed that distances L, M, and N are distances between ranging sensor 911 and point R2L, point R2M, and point R2N respectively. Each sensor can determine that the sheet exists when the distance shorter than distances L, M, and N is detected.

In the case where the path of ranging sensor 911 is indicated by arrow R2A, when ranging sensor 911 detects that the object exists within distance K in arrow R1, or when ranging sensor 911 detects that the object exists within distance L in arrow R2A, it is determined that the output tray is in the "tray fully loaded" state. In the "tray fully loaded" state, the obstacle (sheet) exists against the sheet which is being discharged from the output tray. In the case where the path of ranging sensor 911 is indicated by arrow R2A, when ranging sensor 911 detects that no object exists within distance K in arrow R1, or when ranging sensor 911 detects that no object exists within distance L in arrow R2A, namely, when the distance longer than distances K and L is detected, it is determined that the output tray is not in the "tray fully loaded" state. In the case where the path of ranging sensor 911 is indicated by arrow R2B or R2C, distance M or N is replaced for distance L to perform the detection.

[Hardware Configuration of MFP]

Figure 5:
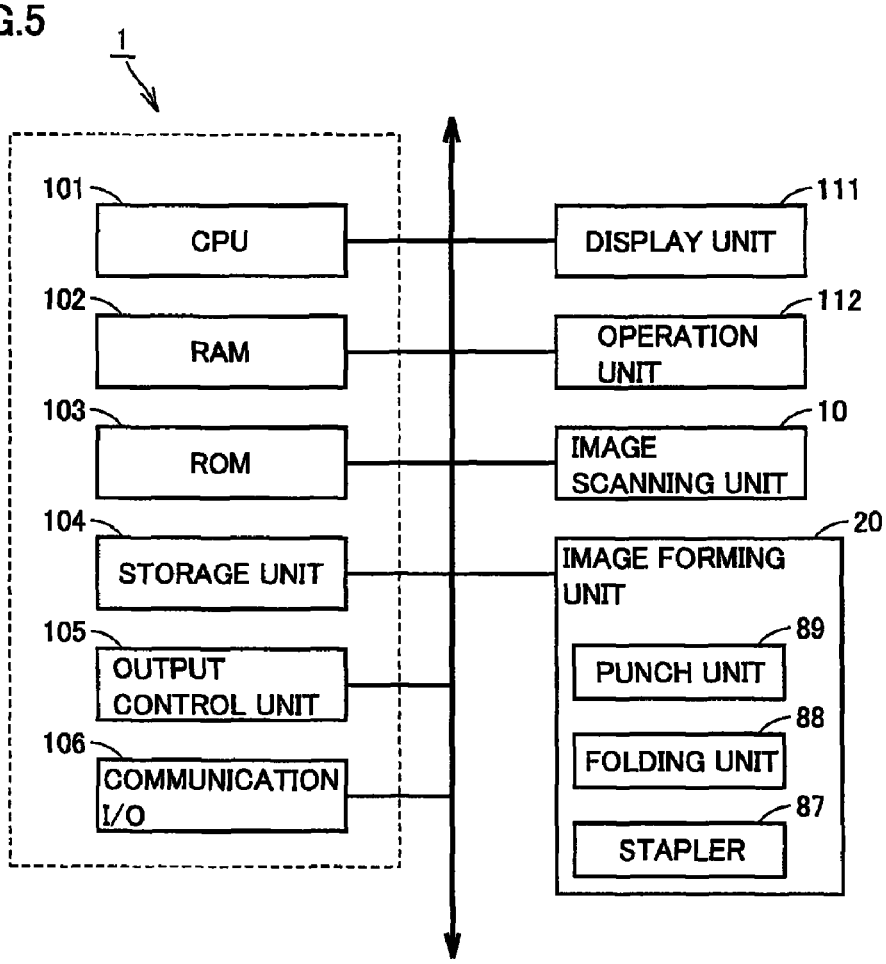
FIG. 5 schematically shows a hardware configuration of MFP of FIG. 1.

FIG. 5 schematically shows a hardware configuration of MFP 1.

Referring to FIG. 5, MFP 1 includes CPU 101 which controls the whole of MFP 1, RAM (Random Access Memory) 102 in which data is tentatively stored, ROM (Read Only Memory) 103 in which a program executed by CPU 101 and a factor are stored, a storage unit 104 in which image data is stored, an output control unit 105 which controls the sheet discharge in discharge unit 90, a communication I/O (in/out) 106 which conducts communication with other devices such as a personal computer through a network, a display unit 111 which displays the state of MFP 1 and information for assisting operation, a operation unit 112 which is operated by a user when the user inputs information to MFP 1, the image scanning unit 10, and the image forming unit 20.

In MFP 1 of the present embodiment, output control unit 105 is provided in discharge unit 90. CPU 101, RAM 102, ROM 103, storage unit 104, and communication I/O 106 are provided in control unit 100. Output control unit 105, CPU 101, RAM 102, ROM 103, storage unit 104, and communication I/O 106 may be provided in other places.

Figure 6:
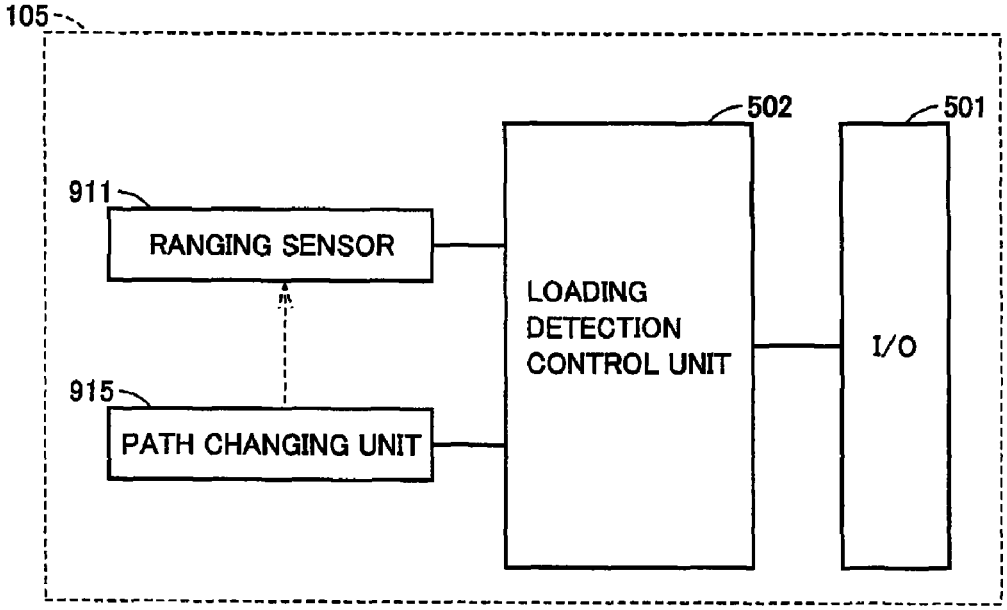
FIG. 6 schematically shows a hardware configuration of an output control unit of FIG. 5.

Referring to FIG. 6, a detailed configuration of output control unit 105 will be described.

Referring to FIG. 6, output control unit 105 includes an interface (I/O) 501 which conducts communication with CPU 101 provided in control unit 100. Output control unit 105 includes ranging sensor 911 and a path changing unit 915 which changes the light direction of ranging sensor 911 according to the size of the sheet discharged on output tray 91 as described with reference to FIGS. 4A to 4C. A loading detection control unit 502 controls the operations of ranging sensor 911 and path changing unit 915. The loading detection control unit 502 conducts communication with CPU 101 through an interface 501.

[Process Performed During Image Formation]

Figure 7:
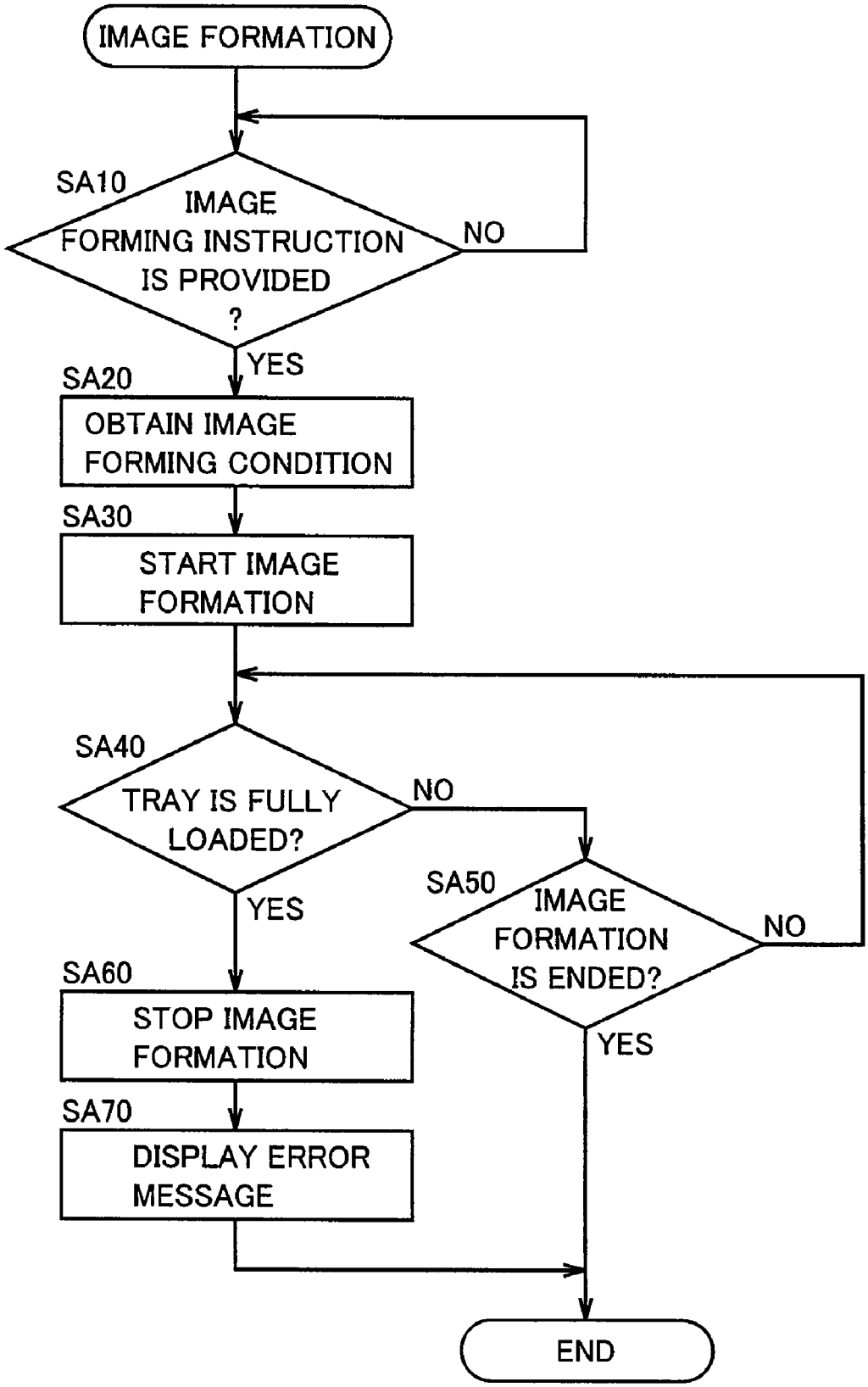
FIG. 7 is a flowchart showing an image forming process performed by CPU (Central Processing Unit) of FIG. 5.
Figure 8:
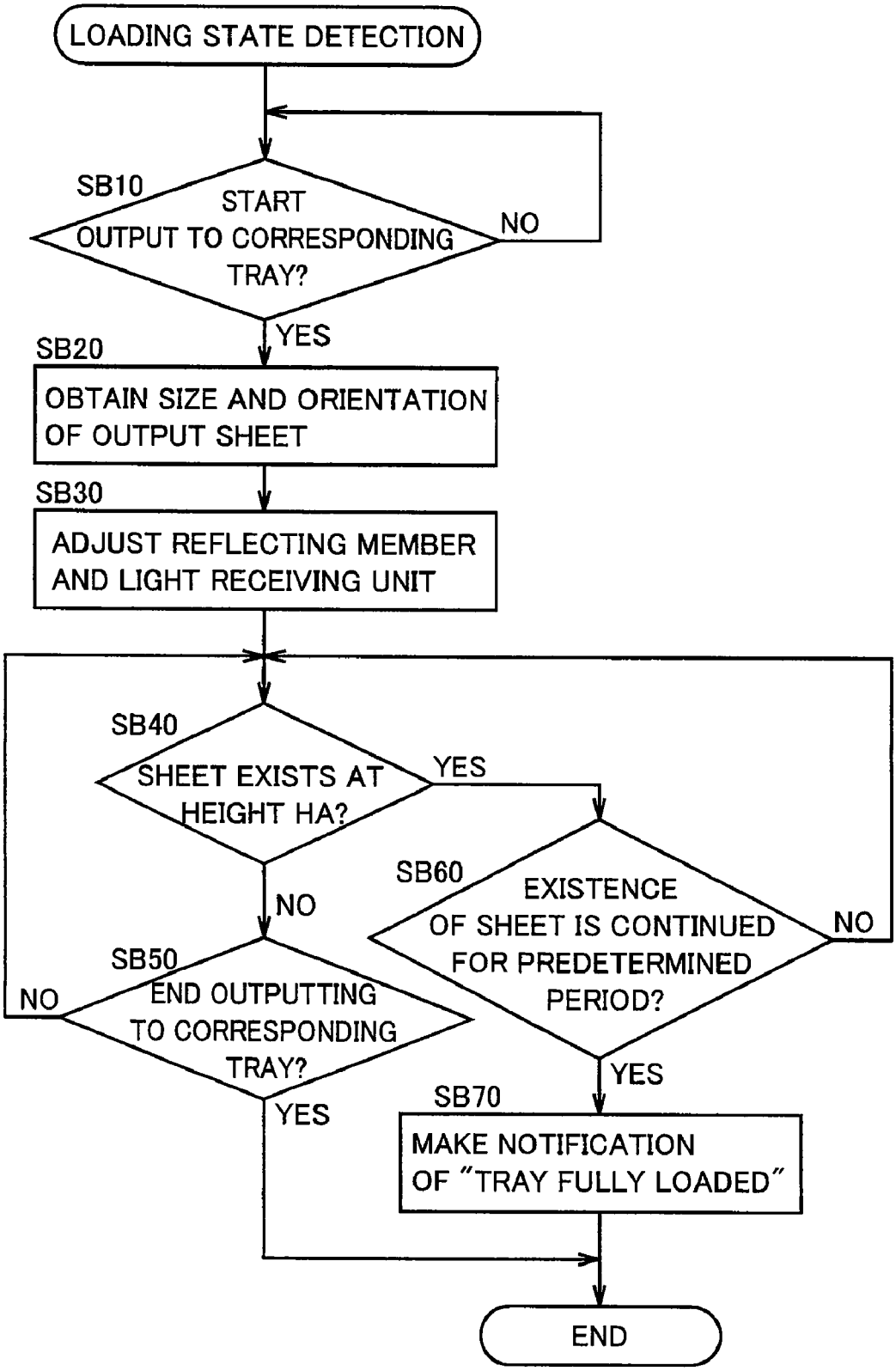
FIG. 8 is a flowchart showing a loading state detecting process performed by a loading detection control unit of FIG. 6.

A process performed in forming the image on the sheet by MFP 1 will be described below. FIG. 7 is a flowchart showing an image forming process performed by CPU 101 during the image formation, and FIG. 8 is a flowchart showing a loading state detecting process performed by loading detection control unit 502 during the image formation.

Referring to FIG. 7, in Step SA10, CPU 101 determines whether or not an instruction for forming the image is provided. Sometimes the instruction for forming the image is inputted by operating operation unit 112, and sometimes the instruction for forming the image is inputted from another device through communication I/O 106.

When CPU 101 determines that the instruction for forming the image is provided, the flow goes to Step SA20.

In Step SA20, CPU 101 obtains a condition necessary to form the image based on the information inputted in the instruction in Step SA10, and the flow goes to Step SA30. Examples of the obtained image forming condition include the image data which is of the image forming target, the size of the sheet on which the image is formed (output sheet size), the number of copies to which the image is formed (the number of output copies), magnification of the image formed on the sheet (output magnification), an output mode (such as both-sided print and N in 1) and an output destination of sheet (output trays 91 to 93).

In Step SA30, CPU 101 causes image forming unit 20 to start the image forming operation based on the image forming condition obtained in Step SA20, and the flow goes to Step SA40.

In Step SA40, CPU 101 determines whether or not the sheet is in the fully loaded state in the output tray which is set to the output destination in the image forming condition obtained in Step SA20. When CPU 101 determines that the sheet is in the fully loaded state, the flow goes to Step SA60. When CPU 101 determines that the sheet is not in the fully loaded state, the flow goes to Step SA50.

The determination whether or not the sheet is in the fully loaded state in the output tray of the output destination is made based on whether or not the loading detecting control unit 502 transmits a signal (later-mentioned "tray fully loaded signal") corresponding to "tray fully loaded" in a period during which the loading detecting control unit 502 performs loading state detection processing.

In Step SA50, CPU 101 determines whether or not the image forming operation based on the image forming condition obtained in Step SA20 is ended. When CPU 101 determines that the image forming operation is ended, CPU ends the image forming process. When CPU 101 determines that the image forming operation is not yet ended, the flow returns to Step SA40.

In Step SA60, CPU 101 stops the image forming operation started in Step SA30, and the flow goes to Step SA70.

In Step SA70, CPU 101 causes display unit 111 to display an error message to end the image forming process.

The displayed error message may encourage the user to remove sheet Placed on the output tray specified as the output destination. In MFP 1, in the case where the image forming process is ended while the image forming operation is stopped to display the error message on display unit 111, the user provides an instruction for removing the sheet from the output tray to form the image again, CPU 101 performs the image formation again based on the image forming instruction in Step SA10, the flow goes to Step SA20 to resume the image forming operation.

Contents of loading state detection processing performed by loading detection control unit 502 will be described below.

Referring to FIG. 8, in Step SB10, loading detection control unit 502 determines whether or not CPU 101 performs the image forming process to start the output of the sheet to one of output trays 91 to 93. When loading detection control unit 502 determines that the output of the sheet is started, the flow goes to Step SB20.

In Step SB20, loading detection control unit 502 obtains information for specifying the size and orientation of the sheet of which the output is started in Step SB10. For example, loading detection control unit 502 make a request to CPU 101 obtaining the image forming condition in Step SA20, which allows loading detection control unit 502 to obtain the information.

In Step SB30, on the basis of the size and orientation of the output sheet obtained in Step SB20, loading detection control unit 502 adjusts the direction of the light beam indicated by arrow R2 in FIG. 2 in the light beams emitted from the ranging sensor 911, and the flow goes to Step SB40. Path changing unit 915 controls the light beam direction. In Step SB30, ranging sensor 911 whose path is controlled is one which is disposed in the output tray specified as the output destination in the information obtained in Step SB20 in the output trays 91 to 93.

In Step SB40, loading detection control unit 502 determines whether or not the sheet (obstacle) exists at the height HA from the bottom surface and at the position of the "tray fully loaded" state in the output tray specified as the output destination. When loading detection control unit 502 determines that the sheet exists, the flow goes to Step SB60. When loading detection control unit 502 determines that the sheet does not exist, the flow goes to Step SB50.

In Step SB50, loading detection control unit 502 determines whether or not the output of the sheet is ended to the output tray specified as the output destination. When loading detection control unit 502 determines that the output of the sheet is not ended yet, the flow returns to Step SB40. When loading detection control unit 502 determines that the output of the sheet is ended, loading detection control unit 502 ends the loading state detection processing. The determination in Step SB50 is realized such that, for example, CPU 101 causes loading detection control unit 502 to monitor whether or not the image forming operation is determined to be ended in accordance with the determination in Step SA50.

In Step SB60, loading detection control unit 502 determines whether or not the existence of the sheet is continued in a predetermined period. When loading detection control unit 502 determines that the existence of the sheet is not continued, the flow returns to Step SB40. When loading detection control unit 502 determines that the existence of the sheet is continued, the flow goes to Step SB70. As used herein, the predetermined period shall mean a time the sheet outputted through the exit roller (exit rollers 901 to 903) is required to traverse the path of the light beam (arrow R1 and arrow R2) emitted from ranging sensor 911 before reaching the output tray (output trays 91 to 93) or a time to which allowance is appropriately added to the time.

In Step SB70, loading detection control unit 502 notifies CPU 101 of "tray fully loaded", and loading detection control unit 502 ends the loading state detection processing. Specifically, loading detection control unit 502 notifies CPU 101 of the "tray fully loaded" notification by transmitting a signal (tray fully loaded signal) corresponding to "tray fully loaded".

In the present embodiment described above, the ranging unit is formed by ranging sensor 911 and the area setting means is formed by path changing unit 915.

Figure 10:
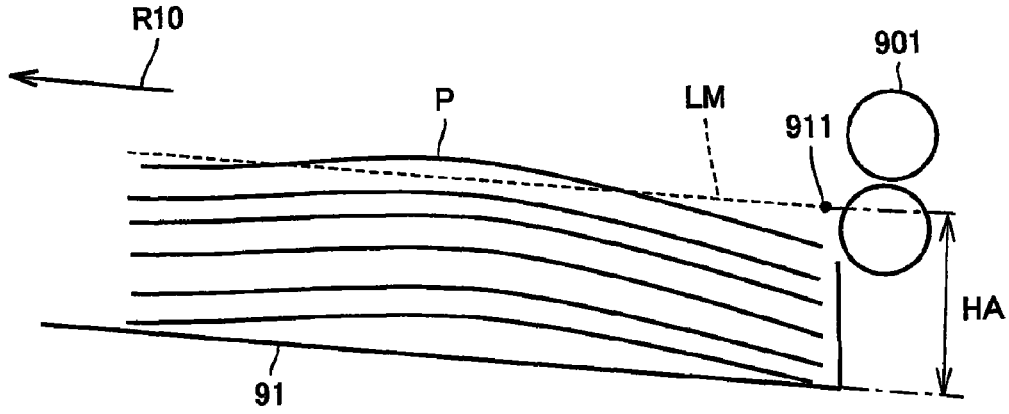
FIG. 10 schematically shows a distance measurement range of a ranging sensor when a loading state of a sheet on the output tray is detected in MFP of FIG. 1.
Figure 11:
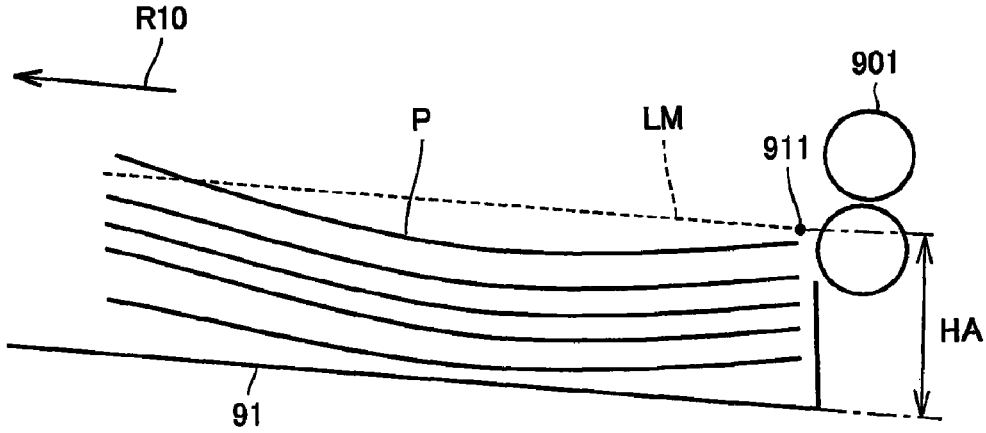
FIG. 11 schematically shows a distance measurement range of a ranging sensor when a loading state of a sheet on the output tray is detected in MFP of FIG. 1.

FIGS. 10 and 11 schematically show the neighborhood of the output tray 91 of FIG. 3 when viewed from the side face. In FIGS. 10 and 11, a broken line LR extending from ranging sensor 911 indicates the path of the light beam (arrow R1 and arrow R2) emitted from ranging sensor 911. The path is located at the predetermined distance (distance HA in FIG. 10) from the bottom surface of the output tray 91 and in substantially parallel with the bottom surface.

Referring to FIGS. 10 and 11, in MFP 1, as shown by the broken line LR, it is determined whether or not at least a part of sheet P exists at distance HA from the bottom surface of output tray 91 in the range of rear end to the front end in the discharge direction (arrow R10) of the sheet on output tray 91. Therefore, it can be detected that a part of sheet P exists at distance HA from the bottom surface of output tray 91, in the case where the sheet on output tray 91 is curled so as to swell in the central portion in the discharge direction as shown in FIG. 10, or in the case where the sheet is curled so as to swell in the front-end and rear-end portions in the discharge direction (arrow R10) as shown in FIG. 11, namely, even if the sheet is placed in the state in which portions of the sheet differ from one another in the height (separated by distance HA or more from the bottom surface of output tray 91).

Figure 12:
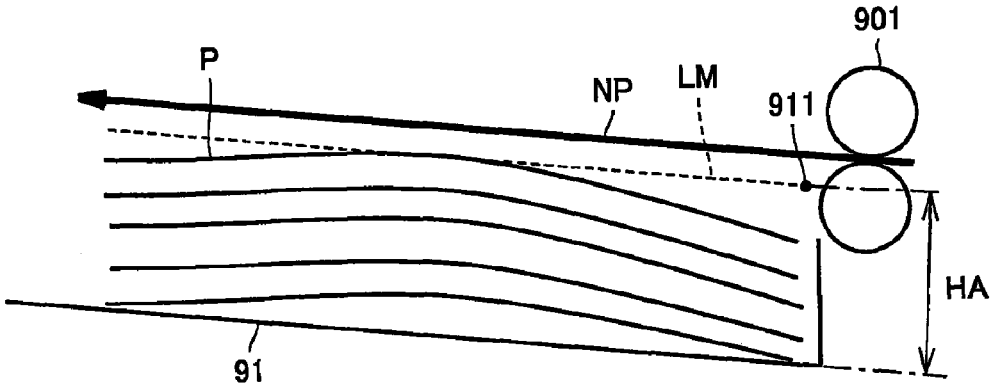
FIGS. 12 and 13 are views for explaining an effect of detection of a loading state of a sheet on the output tray in MFP of FIG. 1.
Figure 13:
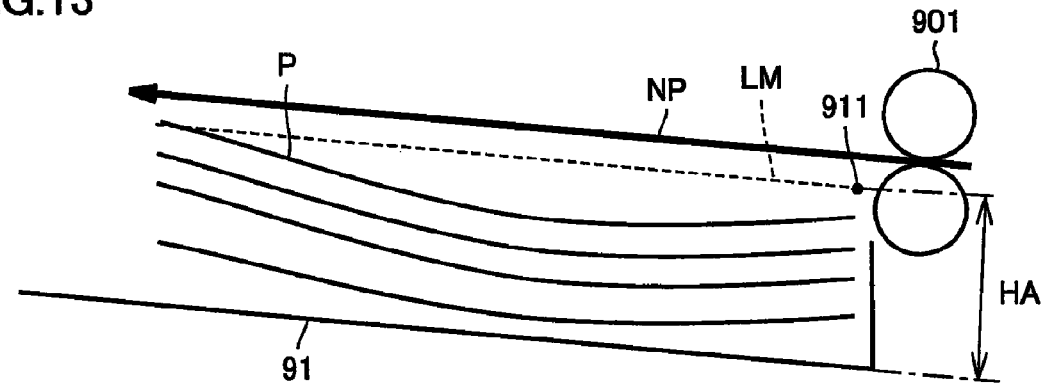
Figure 14:
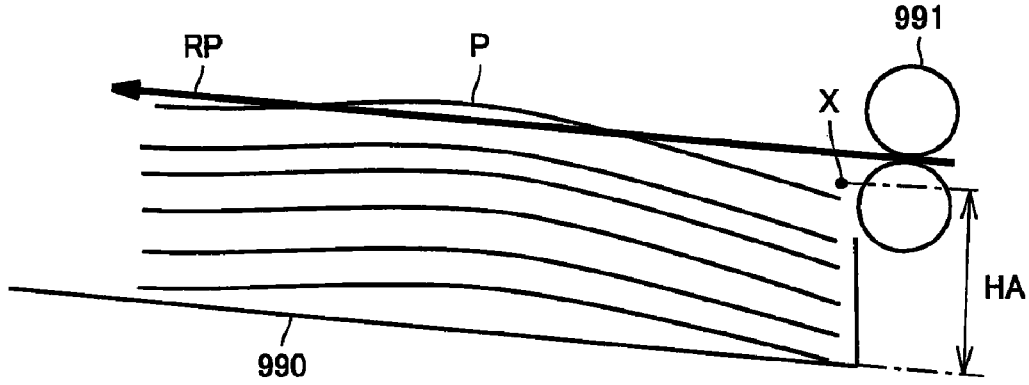
FIG.14 PRIOR ART
FIGS. 14 and 15 are views for explaining a problem in detecting a loading state of a sheet on the output tray in a conventional MFP.
Figure 15:
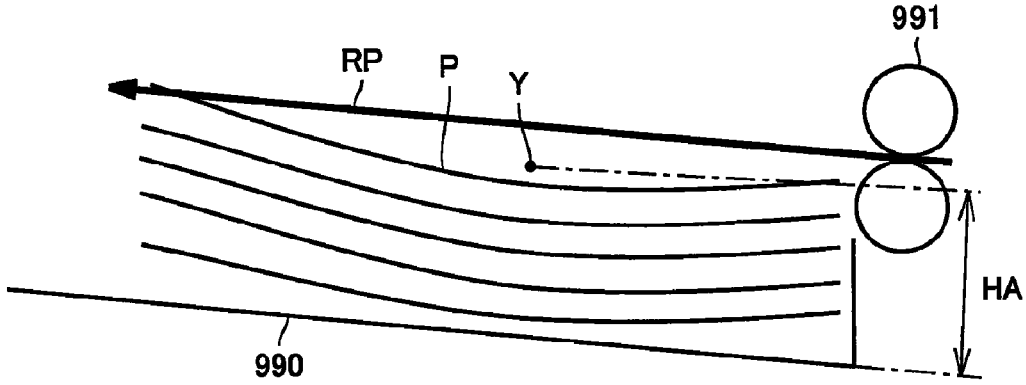
FIG.15 PRIOR ART

In the present embodiment, even in the cases shown in FIGS. 12 and 13, the existence of the sheet is detected at a position lower than a path NP of the sheet newly discharged onto output tray 91 in the overall range from the rear end to the front end of the sheet on output tray 91 in discharge direction R10. Therefore, the newly-discharged sheet can surely be avoided from pushing out the sheet already placed on output tray 91. FIG. 12 shows a state in which a central portion of sheet P on the output tray 91 swells, and FIG. 13 shows a state in which rear-end and front-end portions of sheet P on the output tray 91 swells.

In the loading state detection processing, the "tray fully loaded signal" is not outputted when the state in which the sheet is located on the path of the light beam emitted from ranging sensor 911 is not continued for the predetermined period in Step SB60. This is because the state in which the newly-discharged sheet passes temporarily through the optical path shown by the broken line LR is not considered to be in the fully loaded state of output tray. Therefore, the false detection can be prevented for "tray fully loaded".

In the present embodiment, the path (i.e., path in which the ranging sensor 911 measures the distance) of the light beam emitted from ranging sensor 911 includes a component in a direction perpendicular to discharge direction R10 as shown by arrow R1 and arrow R2A, arrow R1 and arrow R2B, or arrow R1 and arrow R2C in FIG. 3. Therefore, ranging sensor 911 can detect the existence of the sheet at the height HA in the overall range (rear end to front end) in discharge direction R10 for sheet P on output tray 91.

Thus, in the present embodiment described above, the three kinds of paths corresponding to the three kinds of sheet sizes are described as the path of the light beam emitted from ranging sensor 911 with reference to FIGS. 3 and 4A to 4C. MFP 1 is not limited to the number of kinds of the sheet sizes described above.

[Modification]

Figure 9:
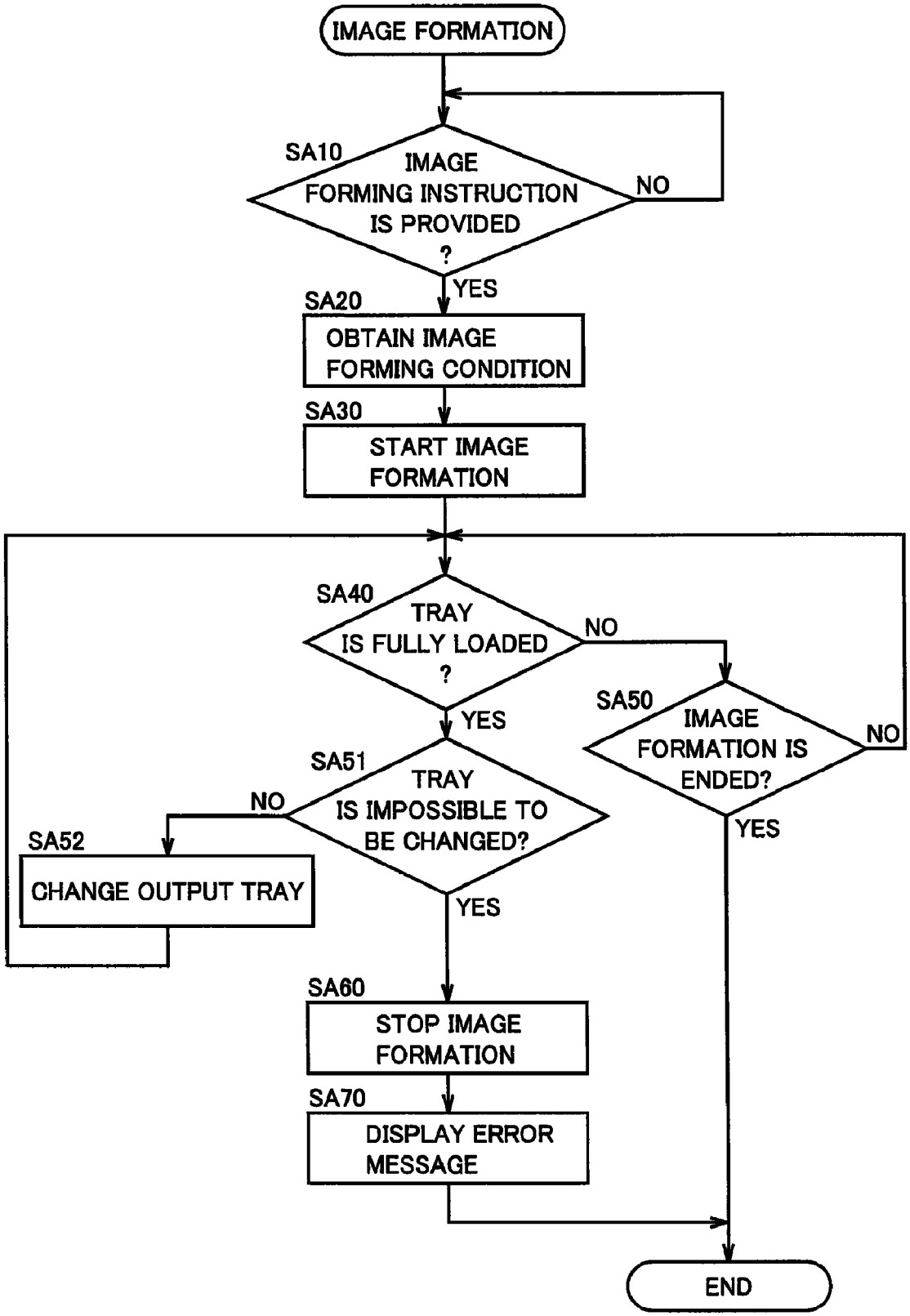
FIG. 9 is a flowchart showing an image forming process performed in a modification of MFP of FIG. 1.

FIG. 9 is a flowchart showing a modification of the image forming process (FIG. 7) in MFP 1.

Referring to FIG. 9, in the modification, CPU 101 performs the same process as that of FIG. 7 in Step SA10 to Step SA30.

That is, in Step SA10, CPU 101 determines whether or not the instruction for forming the image is inputted. When CPU 101 determines that the instruction for forming the image is inputted, the flow goes to Step SA20. In Step SA20, CPU 101 obtains the condition necessary to form the image, and the flow goes to Step SA30. In Step SA30, CPU 101 causes image forming unit 20 to start the image forming operation based on the image forming condition obtained in Step SA20, and the flow goes to Step SA40.

In the process shown in FIG. 7, CPU 101 determines whether or not the sheet is in the fully loaded state in the output tray specified as the output destination in Step SA40, and CPU 101 stops the image forming operation in Step SA60 when determining that the sheet is in the fully loaded state in the output tray specified as the output destination.

On the other hand, in MFP 1 of the modification, even if CPU 101 determines that the sheet is in the fully loaded state in the one of output trays 91 to 93, the image forming operation is continued by changing the output trays specified as the output destination as much as possible.

Referring to FIG. 9, in the modification, when CPU 101 determines that the sheet is in the fully loaded state in the output tray specified as the output destination, CPU 101 determines whether or not another output tray specified as the output destination exists in Step SA51. Specifically, CPU 101 determines whether or not the output tray in which the sheet is not in the fully loaded state exists in output trays 91 to 93. When the output tray in which the sheet is not in the fully loaded state exists, CPU 101 determines that the output trays can be changed, and the flow goes to Step SA52. When the output tray in which the sheet is not in the fully loaded state does not exist, CPU 101 determines that the output trays cannot be changed, and the flow goes to Step SA60.

In Step SA52, CPU 101 changes the output trays specified as the output destination, and flow returns to Step SA40. In Step SA40, when CPU 101 determines that the sheet is in the fully loaded state in the output tray 91, CPU 101 determines whether or not the sheet is in the fully loaded state in the output tray 92. When CPU 101 determines that the sheet is not in the fully loaded state in the output tray 92, the output destination is changed to output tray 92. When CPU 101 determines that the sheet is also in the fully loaded state in the output tray 92, CPU 101 determines whether or not the sheet is in the fully loaded state in the output tray 93. When CPU 101 determines that the sheet is not in the fully loaded state in the output tray 93, the output destination is changed to output tray 93. Then, the sheet is discharged to the changed output tray 92 or output tray 93. On the other hand, when CPU 101 determines that the sheet is also in the fully loaded state in the output tray 93, the flow goes to Step SA60.

In Steps SA60 and SA70, the same process as that of FIG. 7 is performed.

That is, in Step SA60, CPU 101 stops the image forming operation started in Step SA30, and the flow goes to Step SA70. In Step SA70, CPU 101 causes display unit 111 to display the error message, and CPU 101 ends the image forming process.

The control described with reference to FIG. 9 is performed in the modification. Therefore, in the case where the sheet is in the fully loaded state in one of output trays 91 to 93, the interruption of the image forming operation started in MFP 1 can be prevented as much as possible.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus comprising:

an output tray on which a sheet is placed;

a discharge unit which discharges the sheet onto said output tray;

a ranging unit which includes a light projecting element and a detecting element, emits light from said light projecting element from a position located away by a predetermined distance from a bottom surface of said output tray in a sheet loading direction on a line in parallel with the bottom surface of said output tray and intersecting a direction orthogonal to a direction in which said discharge unit discharges the sheet, and measures a distance to an object based on a detection position on said detecting element which detects light reflected by the object;

a size obtaining unit which obtains a size of the sheet discharged onto said output tray;

a light path changing unit which changes a light path emitted by said light projecting element according to the sheet size obtained by said size obtaining unit; and a control unit which stops sheet discharge performed by said discharge unit when the distance measured by said ranging unit is lower than a specific distance.

2. The image forming apparatus according to claim 1, wherein a plurality of said output trays are provided, said discharge unit discharges the sheet onto one of said plurality of output trays, and said control unit changes a destination of sheet discharge performed by said discharge unit to another output tray from said output tray onto which said discharge unit discharges the sheet, when the distance measured by said ranging unit is lower than said specific distance.

3. The image forming apparatus according to claim 1, wherein said ranging unit includes as an area where the distance is measured a central portion of the sheet on said output tray in the direction in which said discharge unit discharges the sheet.

4. The image forming apparatus according to claim 1, wherein the light emitted in a direction intersecting a direction orthogonal to a direction in which said discharge unit discharges the sheet passes through a diagonal corner of the sheet from one side on said output tray, and said light projecting element further emits light in a direction orthogonal to said discharging direction.

5. A method of controlling an image forming apparatus including a discharge unit which includes a light projecting element and a detecting element and discharges a sheet onto an output tray, the method comprising the steps of:

emitting light from said light projecting element from a position located away by a predetermined distance from a bottom surface of said output tray in a sheet loading direction on a line in parallel with the bottom surface of said output tray and intersecting a direction orthogonal to a direction in which said discharge unit discharges the sheet, and measuring a distance to an object based on a detection position on said detecting element which detects light reflected by the object;

obtaining a size of the sheet discharged onto said output tray;

changing a light path emitted by said light projecting element according to said obtained sheet size;

determining whether or not said distance measured in the distance measuring step is lower than a specific distance; and stopping discharge of the sheet to said output tray performed by said discharge unit when the distance measured in the distance measuring step is determined to be lower than said specific distance.

6. The method of controlling an image forming apparatus according to claim 5, wherein said image forming apparatus is provided with a plurality of said output trays, the method further comprising the step of changing a destination of sheet discharge to another output tray from said output tray onto which the sheet is discharged, when the distance measured in said distance measuring step is lower than said specific distance.

7. The method of controlling an image forming apparatus according to claim 5, wherein said distance measuring step includes as an area where the distance is measured a central portion of the sheet on said output tray in the direction in which the sheet is discharged.

8. The method of controlling an image forming apparatus according to claim 5, wherein the light emitted in a direction intersecting a direction orthogonal to a sheet discharging direction passes through a diagonal corner of the sheet from one side on said output tray, and said light projecting element further emits light in a direction orthogonal to said discharging direction.

* * * * *